US008018390B2

(12) United States Patent
Davidson et al.

(10) Patent No.: US 8,018,390 B2
(45) **Date of Patent: *Sep. 13, 2011**

(54) CELLULAR ANTENNA AND SYSTEMS AND METHODS THEREFOR

(75) Inventors: Darren Davidson, Laguna Niguel, CA (US); Philip Sorells, Corinth, TX (US); Bobby Webb, Allen, TX (US); Kevin Eldon Linehan, Rowlett, TX (US); Louis John Meyer, Shady Shores, TX (US)

(73) Assignee: Andrew LLC, Hickory, NC (US)

( * ) Notice: Subject to any disclaimer, the term of this patent is extended or adjusted under 35 U.S.C. 154(b) by 1008 days.

This patent is subject to a terminal disclaimer.

(21) Appl. No.: 11/488,216

(22) Filed: Jul. 18, 2006

(65) Prior Publication Data

US 2007/0063911 A1 Mar. 22, 2007

Related U.S. Application Data

(63) Continuation-in-part of application No. 11/399,627, filed on Apr. 6, 2006, now Pat. No. 7,639,196, which is a continuation-in-part of application No. 10/312,979, filed on Jun. 16, 2003, now Pat. No. 7,899,496.

(51) Int. Cl.
*H01Q 19/06* (2006.01)
*H01Q 3/12* (2006.01)

(52) U.S. Cl. ..... 343/754; 343/760; 343/757

(58) Field of Classification Search ..... None
See application file for complete search history.

(56) References Cited

U.S. PATENT DOCUMENTS

| | | | | |
|---|---|---|---|---|
| 4,124,852 | A | 11/1978 | Steudel | |
| 4,445,119 | A | 4/1984 | Works | |
| 4,495,706 | A | 1/1985 | Kaminski | |
| 4,827,270 | A | 5/1989 | Udagawa et al. | |
| 5,115,248 | A | 5/1992 | Roederer | |
| 5,151,706 | A | 9/1992 | Roederer et al. | |
| 5,194,874 | A * | 3/1993 | Perrotta | 343/757 |
| 5,333,001 | A | 7/1994 | Profera, Jr. | |
| 5,347,286 | A | 9/1994 | Babitch | |
| 5,481,588 | A | 1/1996 | Rickli et al. | |
| 5,488,558 | A | 1/1996 | Ohki | |
| 5,528,248 | A | 6/1996 | Steiner et al. | |
| 5,528,518 | A | 6/1996 | Bradshaw et al. | |

(Continued)

FOREIGN PATENT DOCUMENTS

CA 2220745 8/1998

(Continued)

OTHER PUBLICATIONS

International Search Report for PCT/NZ01/00137 ; Jul. 10, 2001.

(Continued)

*Primary Examiner* — Trinh V Dinh
(74) *Attorney, Agent, or Firm* — Husch Blackwell LLP

(57) ABSTRACT

A cellular communications antenna including sensors for determining position and/or orientation of the antenna. Position information may be obtained using, for example, a GPS receiver or by triangulation. Orientation information may be obtained using, for example, an electronic compass and/or gyroscope and/or an inclinometer.

Position and/or orientation information may be utilised locally to control attributes of the antenna or may be communicated to a central controller which may control attributes of the antenna. Signals may be sent to a central controller to indicate that an attribute of the antenna is outside a desired range.

6 Claims, 6 Drawing Sheets

U.S. PATENT DOCUMENTS

| | | | | |
|---|---|---|---|---|
| 5,596,329 | A | 1/1997 | Searle et al. | |
| 5,647,134 | A | 7/1997 | Chou | |
| 5,734,349 | A | 3/1998 | Lenormand et al. | |
| 5,760,748 | A | 6/1998 | Beckingham | |
| 5,818,385 | A | 10/1998 | Bartholomew | |
| 5,917,455 | A | 6/1999 | Huynh et al. | |
| 5,940,026 | A | 8/1999 | Popeck et al. | |
| 5,949,370 | A | 9/1999 | Smith et al. | |
| 6,016,120 | A | 1/2000 | McNabb et al. | |
| 6,078,824 | A | 6/2000 | Sogo | |
| 6,083,353 | A | 7/2000 | Alexander et al. | |
| 6,097,267 | A | 8/2000 | Hampel | |
| 6,198,458 | B1 | 3/2001 | Heinz et al. | |
| 6,239,744 | B1 | 5/2001 | Singer et al. | |
| 6,246,674 | B1 | 6/2001 | Feuerstein et al. | |
| 6,359,585 | B1 | 3/2002 | Bechman et al. | |
| 6,407,911 | B1 | 6/2002 | Spence et al. | |
| 6,480,147 | B2 | 11/2002 | Durst et al. | |
| 6,529,131 | B2 | 3/2003 | Wentworth | |
| 6,542,117 | B1 | 4/2003 | Broughton | |
| 6,549,915 | B2 | 4/2003 | Abbott, III et al. | |
| 6,677,896 | B2 | 1/2004 | Singer et al. | |
| 6,735,630 | B1 | 5/2004 | Gelvin et al. | |
| 6,791,477 | B2 | 9/2004 | Sari et al. | |
| 6,973,384 | B2 * | 12/2005 | Zhao et al. | 701/117 |
| 7,173,570 | B1 * | 2/2007 | Wensink et al. | 343/760 |
| 7,249,100 | B2 * | 7/2007 | Murto et al. | 705/50 |
| 7,427,962 | B2 * | 9/2008 | Yang | 343/757 |
| 7,639,196 | B2 * | 12/2009 | Elliot et al. | 343/757 |
| 7,710,323 | B2 * | 5/2010 | Boyanov et al. | 343/700 MS |
| 7,817,096 | B2 * | 10/2010 | Linehan | 343/757 |
| 7,899,496 | B2 * | 3/2011 | Rhodes et al. | 455/562.1 |
| 2003/0179735 | A1 | 9/2003 | Suresh et al. | |
| 2003/0184447 | A1 * | 10/2003 | Otterbach et al. | 340/854.9 |
| 2004/0177032 | A1 | 9/2004 | Bradley et al. | |
| 2004/0222931 | A1 | 11/2004 | Matz et al. | |
| 2005/0057427 | A1 | 3/2005 | Wensink | |
| 2005/0263769 | A1 * | 12/2005 | Chul Ahn | 257/72 |
| 2007/0030208 | A1 * | 2/2007 | Linehan | 343/757 |

FOREIGN PATENT DOCUMENTS

| | | | |
|---|---|---|---|
| CA | 2333922 | | 6/1999 |
| EP | 0 543 509 | B1 | 7/1998 |
| EP | 0 600715 | B1 | 1/1999 |
| EP | 1 032 074 | | 8/2000 |
| EP | 0 984 508 | A3 | 8/2001 |
| EP | 1 464 981 | | 10/2004 |
| GB | 2 298 099 | | 8/1996 |
| GB | 2 325 377 | | 11/1998 |
| GB | 2 288 913 | A | 11/2000 |
| WO | 96/14670 | | 5/1996 |
| WO | 01/03414 | | 1/2001 |
| WO | 01/06595 | | 1/2001 |
| WO | 02/37605 | | 5/2002 |
| WO | 02/47207 | | 6/2002 |
| WO | 2004/109318 | | 12/2004 |

OTHER PUBLICATIONS

Two (2) pages from www.3gnewsroom.com/3g__news/oct__01/news__1247.shtml—Jul. 15, 2002.

One (1) page from www.kmwinc.com/eng/newproducts/contents/3way.htm—Jul. 15, 2002.

COMPENDEX AN 2000-064955659-M; Jun. 2006.

COMPENDEX AN 1998-053955707-M ;May 1998.

Derwent Record Title: "Global Positioning System Compass has Radar Antenna Which Received and Transmits Radar Beam and GPS Antenna which Receives and Transmits GPS Signals, Arranged Inside and Outside Radar Dome Respectively" originally JP 2003084059 ; Mar. 19, 2003.

INSPEC AN 5248176 , 1995.

INSPEC AN 5248191 ; 1995.

INSPEC AN 5249627 , 1995.

INSPEC AN 4513248 ; 1992.

INSPEC AN 4658067 ; 1993.

INSPEC AN 6202654 ; 1997.

INSPEC AN 6202678 ; 1997.

Patent Abstracts of Japan 2002250762 published Sep. 6, 2002.

* cited by examiner

CELLULAR ANTENNA AND SYSTEMS AND METHODS THEREFOR

RELATED APPLICATIONS

This application is a continuation-in-part of, and claims the benefit of priority from application Ser. No. 11/399,627, filed Apr. 6, 2006, entitled A Cellular Antenna and Systems and Methods Therefore (referred to herein as "Elliot"), and currently pending, which is a continuation-in-part of and claims the benefit of priority from application Ser. No. 10/312,979, filed Jul. 10, 2001 (PCT Filing Date), entitled Cellular Antenna (referred to herein as "Rhodes"), and currently pending

FIELD OF THE INVENTION

This invention relates to a cellular communications antenna including sensors for determining the position and/or orientation of a beam of the antenna. This position and/or orientation information may be utilised locally to control attributes of the antenna or may be communicated to a central controller which may control attributes of the antenna.

BACKGROUND OF THE INVENTION

When installing cellular communications antennas it has been the practice to orient the antenna with respect to a support structure using a compass and mechanical inclinometer. This may be difficult and precarious at the top of a tower and it may be inconvenient to make an adjustment if later required.

Where an antenna may be oriented by an actuator, devices for measuring the movement have been provided but these may not always provide correct information as to the actual orientation of the antenna due to limited calibration at setup or due to non-linearities. Furthermore, if the orientation of an antenna changes in use (for example due to bird strike) this may not be known by the network operator and network performance may be compromised.

Knowledge of the true position and orientation of an antenna would simplify installation and allow improved control strategies to be employed.

EXEMPLARY EMBODIMENTS

There is provided a cellular communications antenna including sensors for determining position and/or orientation of the antenna. This allows simplified installation and advanced control strategies to be employed. A number of embodiments are described and the following embodiments are to be read as non-limiting exemplary embodiments only.

According to one exemplary embodiment there is provided a cellular communications antenna comprising:

an array antenna for producing a beam;

an antenna orientation sensor mounted upon or near the antenna and configured to develop a signal characterizing the orientation of the antenna;

an actuator for adjusting an attribute of the array antenna or the beam; and an antenna controller responsive to the sensor signal and configured to control the actuator to achieve a desired antenna or beam configuration.

According to another exemplary embodiment there is provided a cellular communications antenna comprising:

an array antenna for producing a beam;

an antenna position and orientation sensor mounted upon or near the antenna and configured to develop a signal characterizing the position and orientation of the antenna;

an actuator for adjusting an attribute of the array antenna or the beam; and an antenna controller responsive to the sensor signal and configured to control the actuator to achieve a desired antenna or beam configuration.

According to another exemplary embodiment there is provided a cellular communications antenna system comprising:

a plurality of array antennas;

a plurality of antenna orientation sensors configured to measure the orientation of each array antenna;

actuators for adjusting an attribute of the array antennas; and a control arrangement configured to receive orientation information from the orientation sensors and adjust an attribute of the array antennas to achieve a desired antenna configuration.

According to another exemplary embodiment there is provided a cellular communications system comprising:

a plurality of antenna systems as hereinbefore described; and a central controller in communication with the antenna systems to receive orientation information and send control information to adjust one or more attribute of the antenna systems.

According to another exemplary embodiment there is provided a method of controlling the orientation of a cellular communications antenna having an orientation sensor for measuring the orientation of the antenna and an actuator for adjusting the orientation of the antenna, comprising:

determining the orientation of the antenna; and, if the orientation of the antenna is not within a desired range, driving the actuator and monitoring the orientation of the antenna measured by the orientation sensor until the orientation of the antenna is within the desired range.

According to another exemplary embodiment there is provided a method of controlling a beam attribute of a cellular communications antenna having an orientation sensor for measuring the orientation of the antenna and an actuator for adjusting a variable element of an antenna feed network of the antenna, comprising:

determining the orientation of the antenna; and controlling the actuator of the antenna to achieve a desired beam pattern in dependence upon the orientation of the antenna.

According to another exemplary embodiment there is provided in a cellular communications system a method of determining the configuration of a plurality of antenna systems comprising a plurality of antennas having orientation sensors for measuring the orientation of the antennas and position sensors for determining the positions of the antennas, the method comprising:

obtaining position and orientation readings for antennas of each antenna system and communicating the readings to a central controller.

According to another exemplary embodiment there is provided a method of configuring a cellular communications antenna including an orientation sensor for measuring the orientation of the antenna and a position sensor for determining the position of the antenna comprising:

determining the position and orientation of the antenna;

storing position and orientation information in a controller; and controlling actuators to adjust attributes of the antenna to provide desired beam coverage based on the stored position and orientation information.

According to another exemplary embodiment there is provided a method of controlling coverage in a cellular communications system including one or more base station, comprising the steps of:

a. obtaining information as to the position and orientation of an antenna of the one or more base station;
b. obtaining desired beam coverage information;
c. calculating a desired antenna orientation for the antenna based at least in part upon the desired beam coverage information; and
d. controlling the antenna so that its beam conforms to the desired antenna orientation.

According to another exemplary embodiment there is provided a method of controlling coverage in a cellular communications system including one or more base station, comprising the steps of:

a. obtaining information as to the position and orientation of an antenna of the one or more base station;
b. displaying a virtual projection of the antenna beam onto a virtual topography corresponding to the environment in which the antenna is located;
c. modifying the antenna beam orientation via a user input device;
d. displaying a modified virtual antenna beam in the virtual environment corresponding to modification via the user input device; and
e. controlling the antenna so that the beam conforms to the desired antenna orientation.

According to another exemplary embodiment there is provided a cellular communications system comprising:

a. a central controller;
b. one or more base station, each base station having one or more antenna and a base station controller which provides information as to the orientation of each antenna to the central controller;
c. wherein the central controller controls the orientation of each antenna to achieve a desired coverage.

According to another exemplary embodiment there is provided a cellular communications system comprising:

a. a central controller; and
b. one or more base station, each base station having one or more antenna and a base station controller which provides information as to the orientation of each antenna to the central controller;

wherein the central controller includes display means for displaying virtual antenna beams representative of the antenna beams of the base stations superposed on a virtual topology and a user input device enabling a user to manipulate a virtual beam to generate control signals sent to control attributes of the corresponding antenna.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

DESCRIPTION OF EMBODIMENTS OF THE INVENTION

Figure 1:
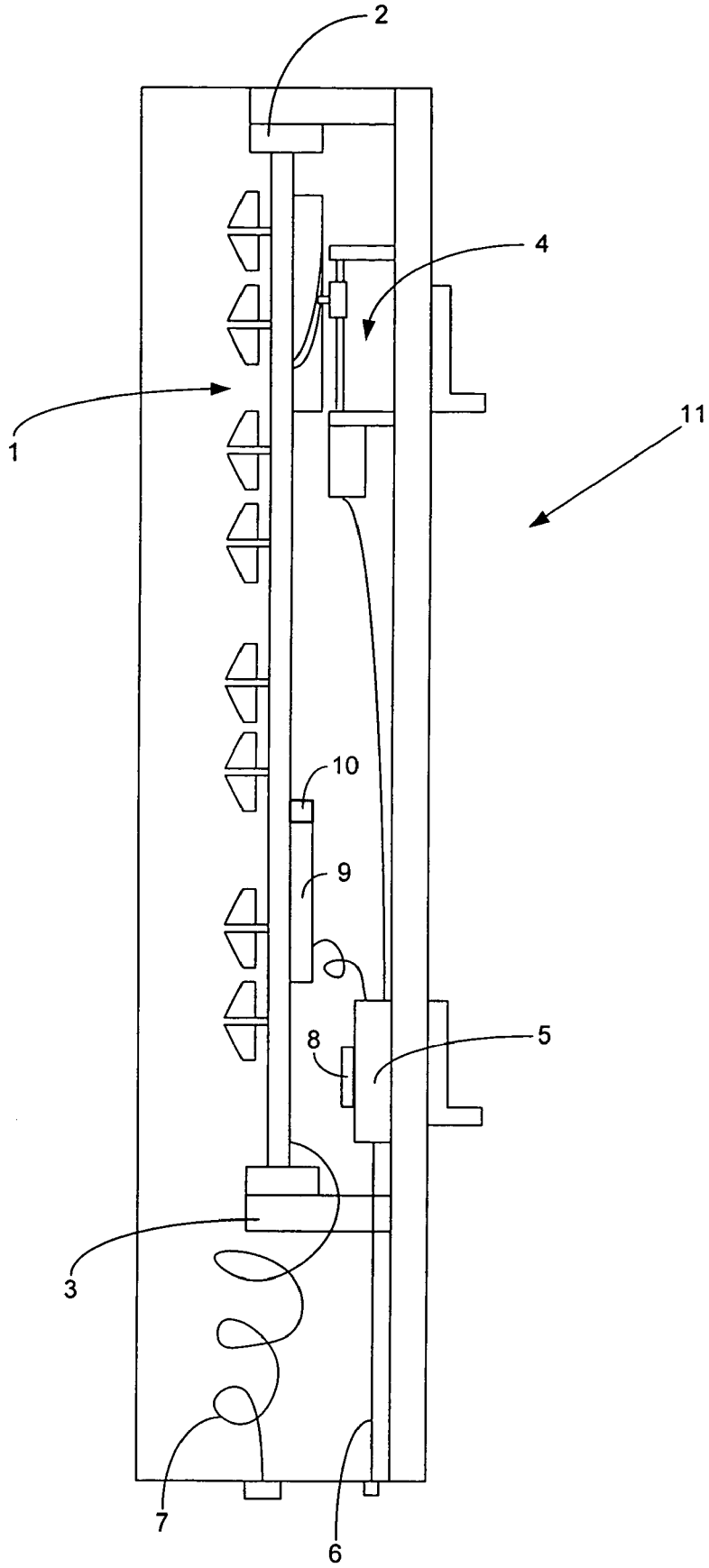
FIG. 1 shows a schematic side view of an antenna according to a first embodiment.
Figure 2:
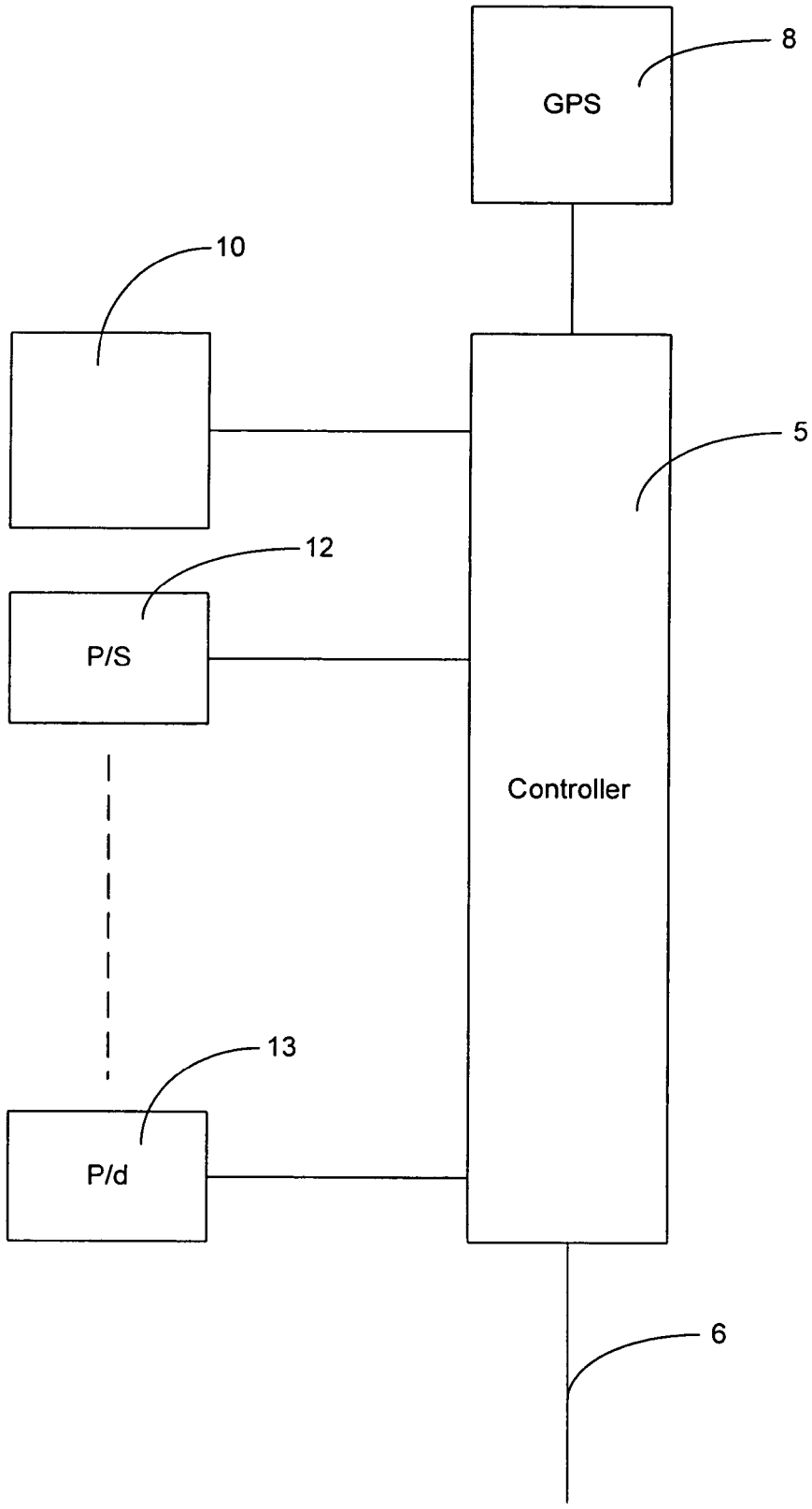
FIG. 2 shows a schematic diagram of control arrangement for the antenna shown in FIG. 1.

FIG. 1 shows an antenna of the type described in Elliot. FIG. 2 shows schematically the control arrangement for the antenna. An array antenna 1 is rotatable about bearings 2 and 3 with rotation of the array antenna being controlled by actuator 4. Control data is sent to controller 5 via an addressable serial bus 6, for example. However, as described in Elliot, control data may be supplied via RF feed line 7 or a wireless link. In this embodiment a global positioning satellite (GPS) receiver 8, for example, supplies position information to antenna controller 5. Controller 5 controls actuators 12 to 13 within feed network 9 to control antenna beam orientation with respect to the array antenna. The actuators 12 to 13 of feed network 9 may adjust phase shifters and or power dividers to adjust the azimuth, downtilt and/or beam width of the antenna beam with respect to the plane of the array antenna as described in Elliot and Rhodes.

In this embodiment an orientation sensor 10 is permanently mounted to the array antenna 1 and develops a signal characterizing the orientation of the antenna. The orientation sensor may include an electronic compass and/or gyroscope to determine beam azimuth and/or an inclinometer and/or gyroscope to measure beam elevation. Instead of absolute orientation sensors, a relative position determining method may be employed, such as determining relative orientation with respect to another base station (or beacon etc.) by determining the direction in which a narrow beam (RF, laser etc) must be directed to be received by the base station or beacon. Knowing the positions of the base stations relative orientations of the antennas can be determined. The sensor signal from orientation sensor 10 is supplied to antenna controller 5.

According to a first embodiment antenna controller 5 of cellular communications antenna 11 may store desired physical orientation or antenna beam orientation information therein. During operation, based on orientation information from orientation sensor 10 and/or position information from GPS receiver 8, controller 5 may control actuator 4 to achieve a desired azimuth orientation of array antenna 1 or may control actuators of feed network 9 to adjust downtilt and/or azimuth and/or beam width of the beam of the antenna with respect to array antenna 1. For example, a digital compass of orientation sensor 10 may detect the actual orientation of array antenna 1 and communicate this to antenna controller 5. Antenna controller 5 may determine whether the orientation of array antenna 1 is within a permitted range of values stored within antenna controller 5. If it is outside a permitted range antenna controller 5 may adjust actuator 4 to change the physical orientation of array antenna 1 until the sensor signal from orientation sensor 10 indicates an orientation within the permitted range.

Permitted values of antenna attributes may be stored within antenna controller 5 and may be updated via addressable serial bus 6 or another communications channel. The permitted ranges of physical orientation and beam orientation attributes may be stored in a schedule in which these values are set for different periods of time, or for variable traffic, variable foliage or other seasonal changes in capacity or signal obstruction, or other operating conditions. For example, coverage may be required from an antenna in the first region for one period of time and another region for another period of time due to varying traffic demand etc. This schedule can be periodically uploaded from a central controller.

Figure 3:
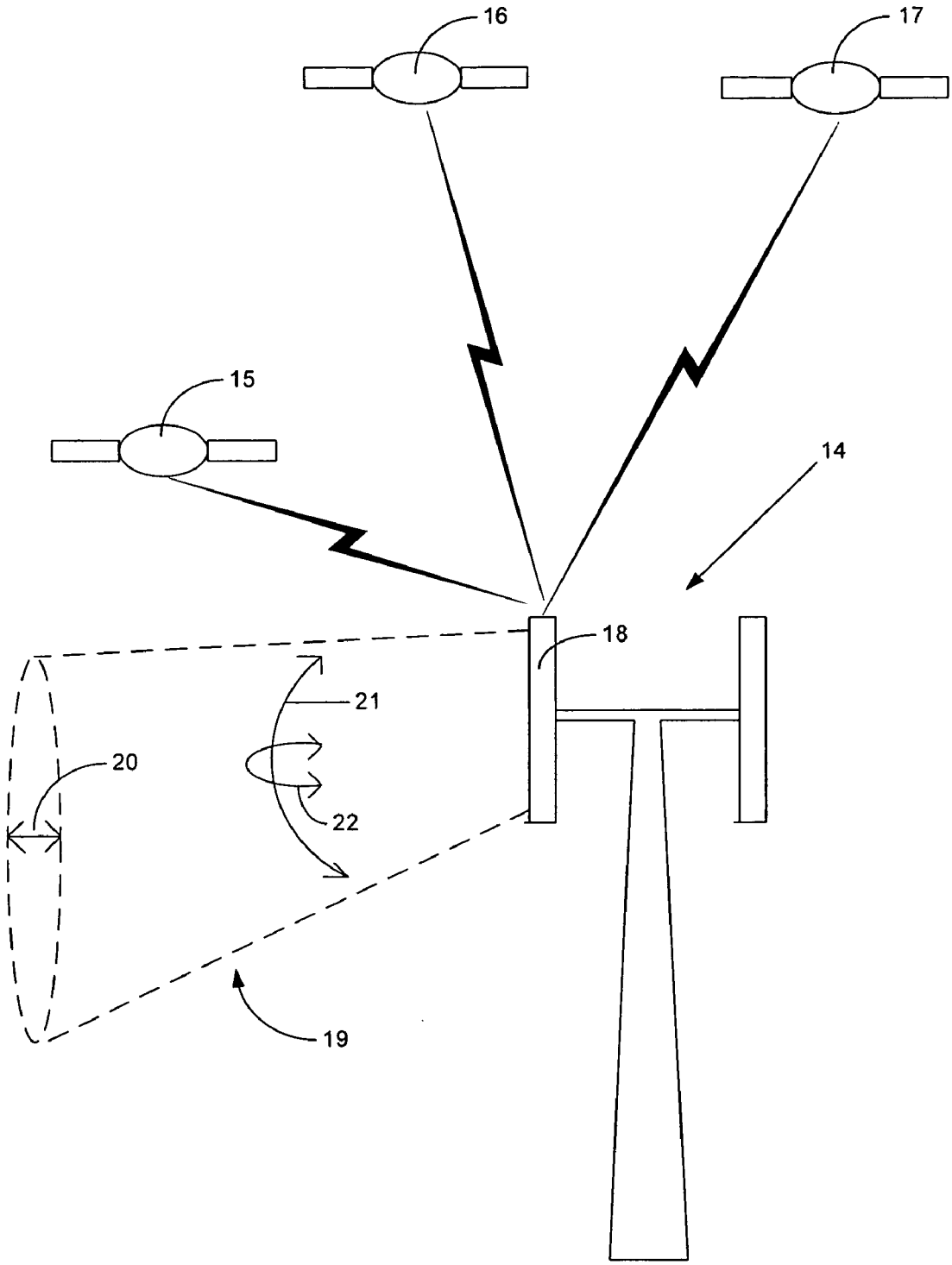
FIG. 3 shows a schematic view of an antenna system and the beam of one antenna.

Referring now to FIG. 3 a schematic view of cellular communications antenna system 14 incorporating the cellular communications antenna shown in FIGS. 1 and 2 is shown. Antenna 18 receives GPS positioning signals from GPS satellites 15, 16 and 17. Using this information the controller of antenna 18 can determine its position. The antenna beam 19 has adjustable beam attributes including beam width 20, beam elevation (referred to herein as beam down tilt) 21 and horizontal beam orientation (referred to herein as beam azimuth) 22. These attributes of the antenna beam may be adjusted so as to provide the desired beam coverage.

Figure 4:
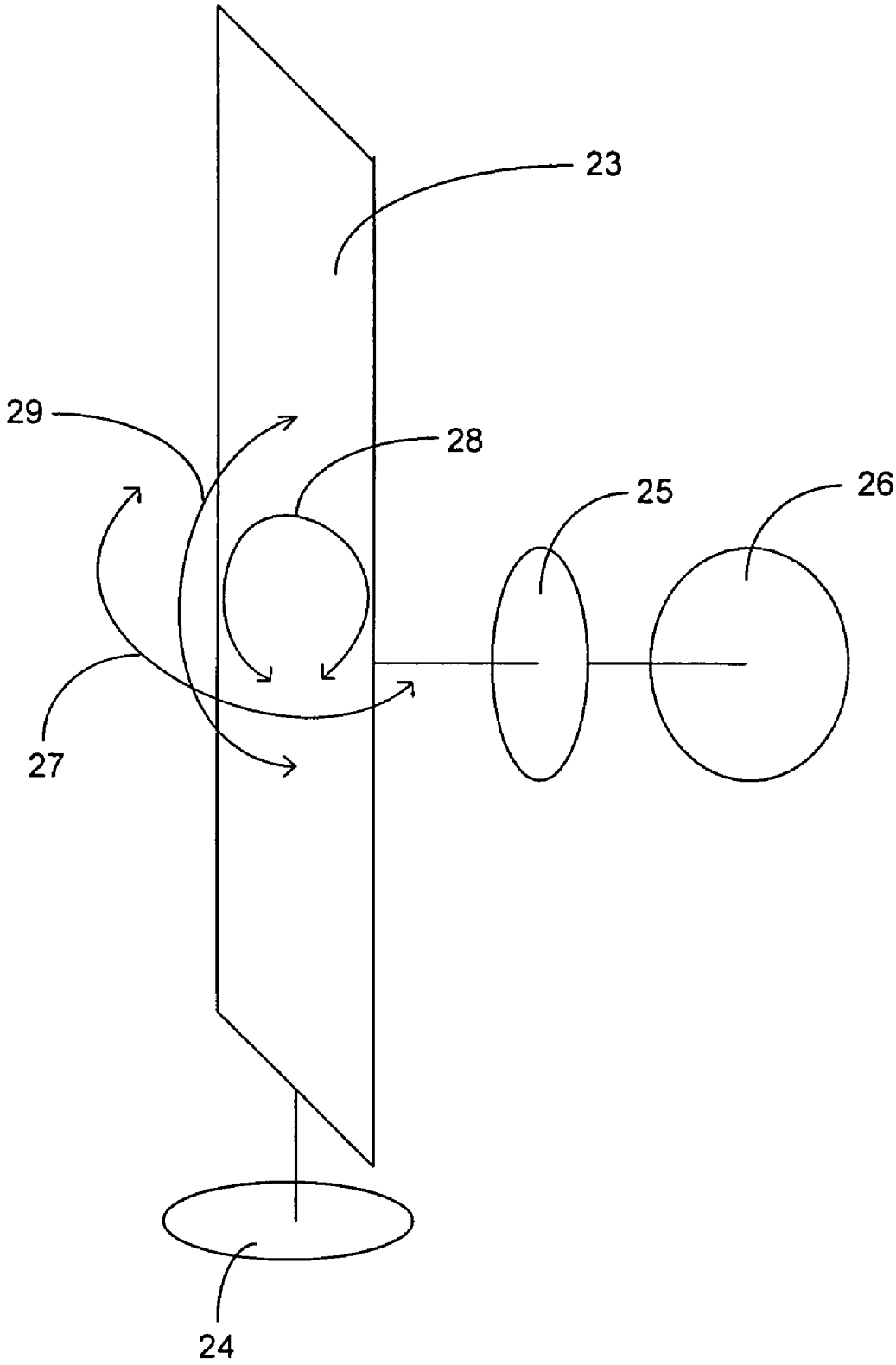
FIG. 4 shows a schematic representation of an antenna having mechanical beam azimuth, tilt and roll actuators.

Additionally or alternatively the orientation of the antenna may be physically adjusted to alter the coverage of the antenna beam. FIG. 4 shows a schematic view of an arrangement for adjusting the physical orientation of antenna 23. Actuators 24, 25 and 26 may respectively adjust beam azimuth 27, roll 28 and down tilt 29. Actuators 24 to 26 may be geared motors which through suitable linkages adjust the orientation of antenna 23 as is well known in the art.

Figure 5:
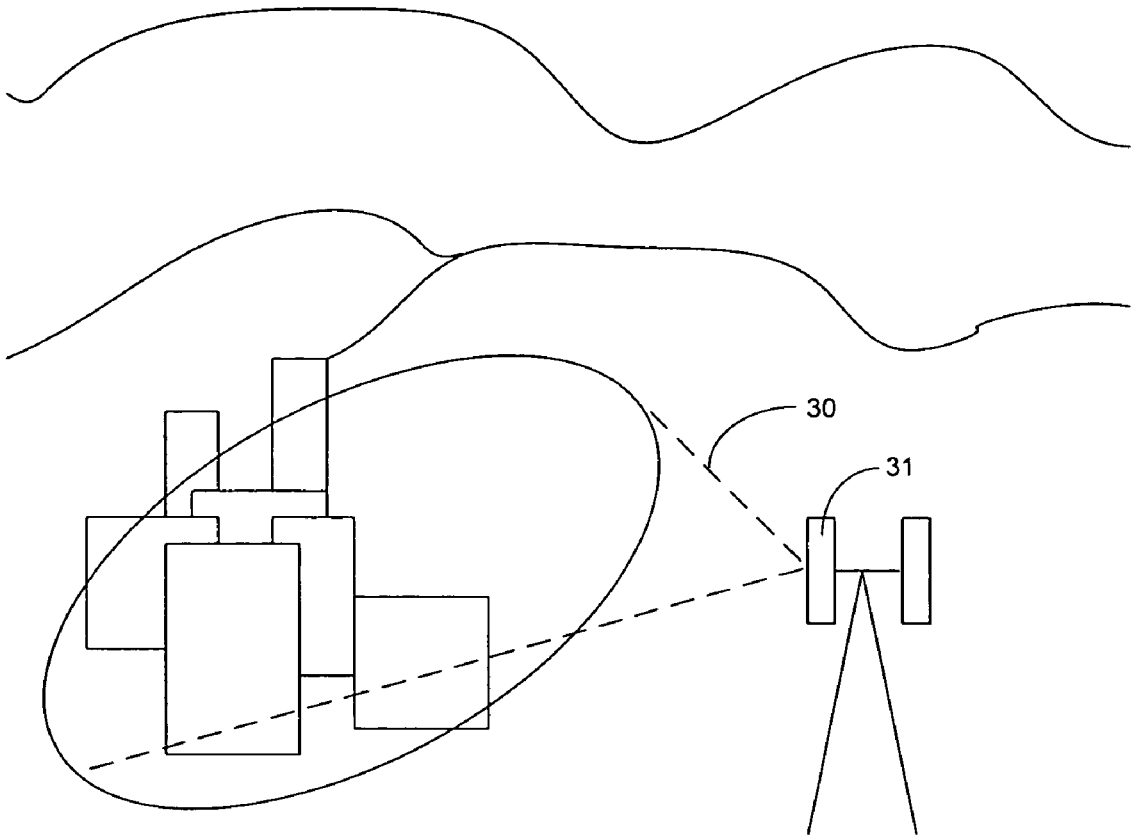
FIG. 5 shows a schematic view of an antenna system and the beam of one antenna projected onto a landscape.

Referring now to FIG. 5 there is shown the beam 30 of antenna 31 projected onto a landscape. It will be appreciated that by adjusting attributes of physical orientation and/or adjusting attributes of the beam of the antenna, beam width, beam azimuth, beam downtilt, and beam roll may be optimised for desired coverage based upon the measured position and orientation of antenna 31. An image like that shown in FIG. 5 may be displayed to a user using 2D or 3D display technology. The topography represents the environment in which antenna 31 is located. Obstructions, such as buildings, may also be shown. Current, desired or historical traffic levels may also be indicated (by colour, texture or other visual attributes). Antenna 31 may be superimposed based on information received as to its physical location derived from a GPS unit at the base station. The orientation of antenna 31 may be based upon orientation information from sensors in antenna 31. The beam shape 30 may be determined based on information as to the configuration of beam shaping elements. It may have a different optical characteristic such as colour or shading depending upon the polarisation of the beam. A user using a virtual reality data glove or other input device may modify beam 30. By grasping the beam with the data glove a user may orient it as desired or by opening and closing fingers, for example, vary beam width. A user is able to observe how modification of the beam affects the virtual beam in the virtual display, and thus how the real beam would project on the topology. This provides a simple intuitive user interface.

Figure 6:
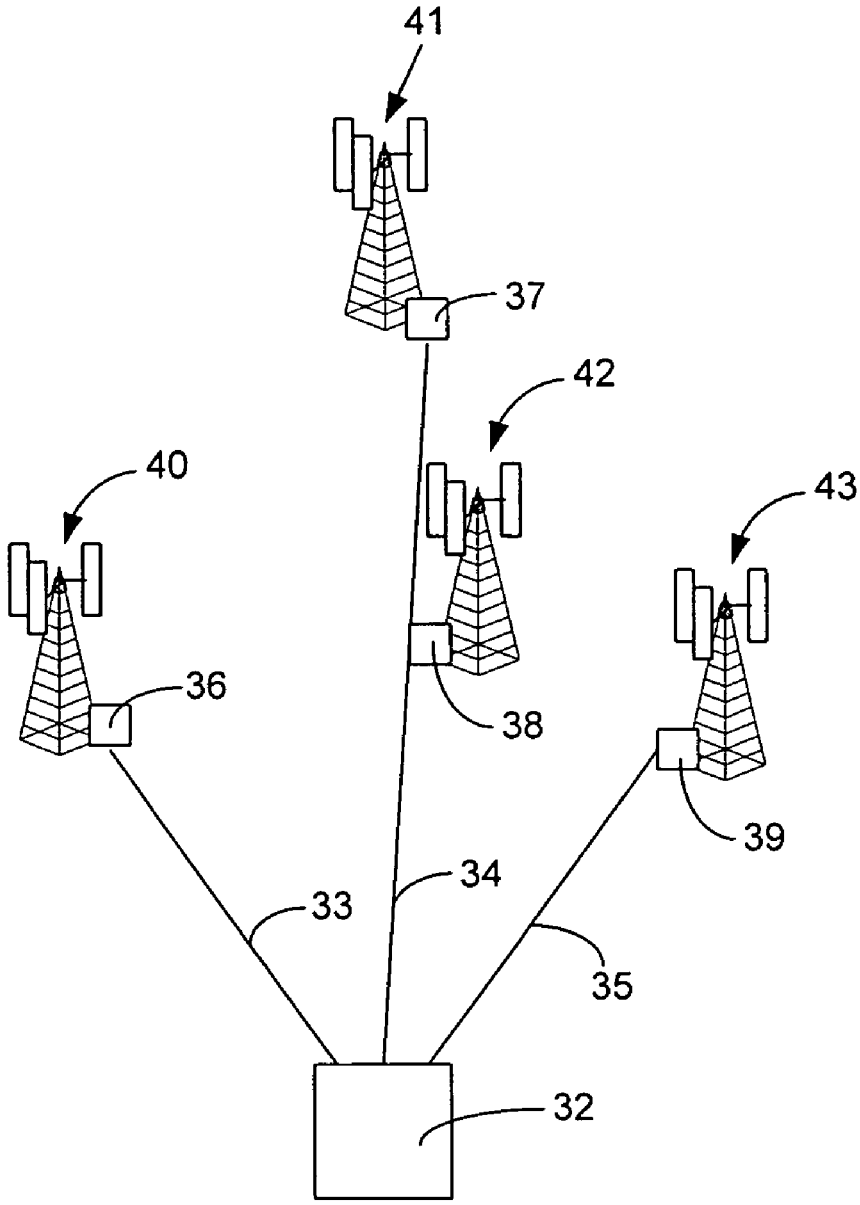
FIG. 6 shows a schematic view of a cellular communications system.

FIG. 6 shows a cellular communication system in which a central controller 32 communicates via backhaul links 33 to 35 with base station controllers 36 to 39. Base station controllers 36 to 39 receive position and/or orientation information from antennas 40 to 43 and provide this information to central controller 32. Alternatively base station controllers 36 to 39 may include a GPS receiver, avoiding the need to provide one in each antenna. Central controller 32 may maintain a database in which the most current position and orientation data is stored, along with historical data if required. Position and orientation information may be sent periodically to central controller 32 or upon request from central controller 32. Central controller 32 may send control commands via base station controllers 36, 37, 38 and 39 to each controller within each antenna to adjust the physical orientation of the antenna and/or antenna beam attributes based upon immediate need, response to predetermined condition changes, or in accordance with a predetermined time schedule, as described above.

In one embodiment when a new antenna is installed it may send position and/or orientation information to central controller 32. Central controller 32 may determine the desired operating parameters for the antenna and send these back to be stored in the base station controller or the controller within each antenna. Each antenna may then control antenna physical orientation and/or beam orientation to satisfy the required operating parameters. Alternatively, the intelligence may be maintained within central controller 32 so that it directly commands each local antenna controller to make an adjustment until it receives position and/or orientation information meeting the required operating parameters. During operation controller 32 may send a schedule of desired operating parameters to the base station controller or antenna controller providing a schedule of operation for different periods. The schedule may provide for different beam coverage for different periods. Further, central controller 32 may monitor system usage and adjust the mechanical orientation and/or beam attributes to provide desired coverage actively as usage changes.

By regularly monitoring the position and orientation of each antenna, central controller 32 can monitor correct operation of an entire cellular communications network. If, for example, an antenna should encounter bird strike and become misaligned, central controller 32 can detect the incorrect orientation of the antenna and, if possible, make adjustment or otherwise properly ensure maintenance is performed. Each antenna controller may be programmed so that if a position or orientation parameter is outside a specified range a signal is sent to central controller 32 notifying it of the exception. Controller 32 can then adjust antenna parameters to compensate or indicate that servicing is required.

It will be appreciated that the graphical user interface described in relation to FIG. 5 may be applied to a system as shown in FIG. 6 to enable an operator to control all antenna beams across a system via a user interface at central controller 32.

The system enables the position and orientation of each antenna to be communicated to the central controller 32 upon installation. The settings of beam shaping elements such as phase shifters and power dividers may also be provided to central controller 32 to enable the shape of the beam of each antenna to be determined. Controller 32 may also be provided with information as to fixed obstructions (buildings etc.) and variable obstructions (e.g. foliage). Controller 32 may further be provided with information as to projected traffic (e.g. typical traffic profiles for different times of the day or for events such as sports events) as well as real-time information as to traffic (e.g. actual current traffic or traffic over a proceeding period). Controller 32 may then calculate the desired physical antenna position and beam configuration for each antenna required to give the desired coverage in a particular typography. Controller 32 may do this by overlaying antenna position and orientation information onto a topographical map of the area to calculate desired coverage. Controller 32 may take into account information as to usage and system coverage requirements for the area concerned. Controller 32 may operate a wide range of control strategies utilising the known antenna position and orientation information as will be apparent to those skilled in the art.

Alternatively an operator may control antenna beam orientation and shape using a user interface. An operator may see the topology off or portion of an area to be controlled with base stations superimposed upon the topology. Beams of the antennas may be projected onto the topology based upon information as to each antenna's position and orientation and the settings of the beam shaping elements of each antenna. The pars duration of each beam may be indicated by colour or some other optical attribute. Buildings and other obstructions may also be shown using visual attributes, such as colour. System traffic may be superimposed upon the topography to show current traffic, historical traffic and/or predicted traffic using colour or some other visual attribute. Where multiple attributes need to be shown in the same space one attribute may be colour and another may be a fill effect such as cross-hatching etc. A user may select a beam using an input device (e.g. amounts, virtual reality data glove etc.) and modify attributes of the antenna beam using the input device. For example an operator may grasp a beam using a virtual reality data glove and change its orientation by moving the data glove. The operator may adjust beam attributes such as being width by opening and closing fingers off the data glove. In this way an operator may adjust a beam while visually observing other beams and the coverage of the beam with respect to traffic in a region and how obstructions affect the beam. It will be appreciated at a variety of input devices could be employed utilizing a range of control strategies.

As an alternative to GPS based position location, triangulation methods may also be employed. Each antenna controller may include an RF receiver for receiving transmissions from known locations, such as cellular towers, to calculate the position of each antenna by triangulation.

There is thus provided an antenna capable of detecting its position and orientation and communicating this to a local or central controller. The antenna may include means to maintain attributes of the antenna within desired parameters. These may be preset or downloaded. A system of such antennas simplifies installation by only requiring antennas to be mounted in approximate orientations as they may subsequently be adjusted by altering the mechanical orientation of the antenna and/or attributes of the antenna beam. The system enables the precise position and orientation of antennas to be determined at any point in time and employed in a range of control strategies.

While the present invention has been illustrated by the description of the embodiments thereof, and while the embodiments have been described in detail, it is not the intention to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A cellular communications antenna comprising:

an array antenna configured to produce a beam and mounted for adjustable orientation;

an antenna orientation sensor mounted on a back side of the array antenna, opposite radiating elements of the array antenna, and configured to develop a signal characterizing the orientation of the antenna;

a plurality of actuators for adjusting the physical orientation of the array antenna and for adjusting attributes of the beam; and an antenna controller responsive to the sensor signal and configured to control the plurality of actuators to achieve a desired array antenna orientation and beam orientation or configuration, wherein at least some of the plurality of actuators adjust beam azimuth, roll, and down tilt of the array antenna, and wherein at least some of the plurality of actuators adjust beam elevation, azimuth, and width of the beam.

2. A cellular communications antenna as claimed in claim wherein the antenna orientation sensor includes an electronic compass, inclinometer, or a gyroscope.

3. A cellular communications antenna as claimed in claim including a global positioning satellite (GPS) receiver.

4. A cellular communications antenna as claimed in claim 1 including an RF receiver for receiving transmissions from known locations and determining the position of the array antenna by triangulation.

5. A cellular communications antenna as claimed in claim wherein the antenna orientation sensor is permanently fixed to the array antenna.

6. A cellular communications antenna comprising:

an array antenna for producing a beam;

antenna position and orientation sensors mounted on a back side of the array antenna, opposite radiating elements of the array antenna, and configured to develop a signal characterizing the position and orientation of the antenna;

a plurality of actuators for adjusting the physical orientation of the array antenna and for adjusting attributes of the beam; and an antenna controller responsive to the sensor signal and configured to control the plurality of actuators to achieve a desired array antenna orientation and beam configuration, wherein at least some of the plurality of actuators adjust beam azimuth, roll, and down tilt of the array antenna, and wherein at least some of the plurality of actuators adjust beam elevation, azimuth, and width of the beam.

* * * * *